United States Patent [19]

Klosk

[11] 4,046,271

[45] Sept. 6, 1977

[54] METHOD FOR COLLECTING, HANDLING AND DISPOSAL OF WASTE MATERIALS

[76] Inventor: Lawrence Klosk, 3977 Sedgwick Ave., Bronx, N.Y. 10463

[21] Appl. No.: 736,216

[22] Filed: Oct. 27, 1976

Related U.S. Application Data

[63] Continuation-in-part of Ser. No. 576,869, May 12, 1975, abandoned.

[51] Int. Cl.[2] ..... B65F 3/00

[52] U.S. Cl. ..... 214/152; 214/38 D; 214/41 A; 232/43.2

[58] Field of Search ..... 214/38 R, 38 D, 41 A, 214/152; 232/43.2

[56] References Cited

U.S. PATENT DOCUMENTS

| | | | |
|---|---|---|---|
| 3,380,600 | 4/1968 | Klanner et al. | 214/38 D |
| 3,640,410 | 2/1972 | Pioch | 214/38 D X |

*Primary Examiner*—Robert G. Sheridan
*Attorney, Agent, or Firm*—James & Franklin

[57] ABSTRACT

A method for collecting, handling and disposing of trash from a collection site, such as a railroad station, to a disposal site, utilizes a receptacle which includes a housing permanently situated at the collection site. The housing receives a coverable container therein and trash is deposited through a self-closing door at the top of the housing and received within the container. The container is admitted into and withdrawn from the housing through an openable sidewall of the housing. Once filled, the container is extracted from the housing, covered and moved to a designated platform area. A train, designed for this purpose, arrives with empty containers, which are unloaded, and receives the full containers. The train moves to a transfer point wherein the containers are removed and emptied into a collection vehicle to be hauled to a disposal site.

3 Claims, 4 Drawing Figures

METHOD FOR COLLECTING, HANDLING AND DISPOSAL OF WASTE MATERIALS

This application is a continuation-in-part of my application Ser. No. 576,869, filed May 12, 1975, now abandoned, entitled "Method and Apparatus for Collecting, Handling and Disposal of Waste Materials". This invention is directed to a method for collecting, handling and disposing of trash.

Waste materials deposited at certain public locations, such as subway or railroad stations, present a continuing problem of collection, handling and disposal. Such locations are frequented by great numbers of people generating large amounts of trash daily. The receptacles available prior to the present invention have been found unsatisfactory in the performance of these tasks. These receptacles are typically comprised of cans, baskets, bags, cardboard boxes and the like. Most have no covers to close the top of the receptacle when it is full or when being carried to the collection vehicle. Some do have detachable covers, while others have attached hinged covers which can be placed over the open top. Practically, however, these covers are of little value since no one is usually available to cover the receptacle when it is full and it remains open even while being handled by the trash collection crew because it is burdensome to cover and then uncover the receptacle within a short span of time, particularly when a large number of receptacles is involved. Thus, since the top of these receptacles remains usually open, the exposed deposited trash is likely to overflow when the receptacle is nearly full, or be spilled when the receptacle is jostled by the wind or by people. The receptacle in this state is a very tempting target for vandals who remove and scatter the trash or turn over the receptacle. Also, some trash is occasionally spilled by the trash collection crew as the filled receptacle is hurriedly lifted and carried to the collection vehicle. Thus, the resulting scene around these receptacles which are designed to keep the area clean is often rather unpleasant and unsightly and additional labor must be used to keep the area clean by collecting the scattered trash.

At sites above or below street level, the problem of trash disposal is particularly acute since bringing the receptacle to street level is a very burdensome and time-consuming manual task. Railroad platforms are a typical example of such a situation. To deal with this problem, the receptacles are emptied directly into a train stopped at the platform rather than being transported to street level for pickup. A train especially designed for this purpoose is used during those house having the least passenger traffic. The trash is brought by train to a dump site or to a transfer point where a vehicle, typically a truck, then carries the trash to a disposal site. Since the receptacles are emptied right at the platform, it is difficult to prevent spilling some trash, either as it is being carried to or put into the train, particularly because of the open top of the receptacle. Some of it even finds its way onto the roadbed through the gap between the train and platform from where it is relatively difficult to pick up and where its accumulation might present a danger to passing trains.

At certain sites experiencing particularly heavy human traffic, such as the above-mentioned railroad platform, several receptacles are positioned at various locations around the site. Emptying these receptacles can be handled in one of two ways. All the receptacles are either brought to a central spot where they are emptied into the collection train, and then returned to their original location, or the collection vehicle is stopped adjacent each individual receptacle. Both techniques are time consuming, burdensome, and often messy with prior art receptacles. The former technique requires transporting the filled receptacles for a distance along the platform. Since each receptacle must be manually lifted and carried, the work is difficult and chances of spillage increase along with the distance traveled and the weariness of the crew. Furthermore, the size of each receptacle is limited by the weight a man can be expected to carry and, thus, more receptacles are required at each site, thereby increasing the time and labor involved in emptying the receptacles. As to the latter technique, making frequent stops is inconvenient and time consuming. Also, the problem of spillage during lifting and carrying of the receptacles applies here, as well. Furthermore, starting and stopping a large vehicle, such as a train, wastes a considerable amount of fuel and is, therefore, inefficient. With both of these techniques requiring heavy manual work and inconvenience to the collection crew, and taking the human factor into account, it usually happens that some receptacles are "overlooked" or skipped, thus leaving a filled receptable to receive the next day's trash, with obvious results.

Accordingly, it is the general object of the present invention to provide an improved method for collecting, handling and disposing of trash.

A more specific object of the present invention is to provide a method for collecting, handling and disposing of trash deposited on mass transit facilities and, in particular, on railroads which have underground or elevated platforms.

Another object of the present invention is to provide a method for handling full trash rceptacles that minimizes spillage.

A further object of the present invention is to provide a method for handling trash receptacles that requires no manual lifting.

A still further object of the present invention is to provide a method for loading trash onto a collection vehicle quickly and neatly.

Yet another object of the present invention is to provide a method for collecting, handling and disposing of trash which requires a minimum work force and minimizes the likelihood of improper performance of work force tasks.

Still another object of the present invention is to provide a trash receptacle which is secure from vandalism.

It is another object of the present invention to provide a trash receptacle which retains deposited trash securely within a normally fully enclosed container.

In accordance with these objects, a method for collecting, handling and disposing of trash are provided utilizing a receptacle comprised of a housing and a container. The housing is permanently secured in place at a particular location and snugly receives the container therein. Trash is deposited through a self-closing, hinged door at the top of the housing. The trash is received within the container and does not fall between it and the housing because of the snug fit. The container is admitted into and withdrawn from the housing through a gate comprising a sidewall of the housing, which can be swung outward on a set of hinges and locked shut after insertion of the container. Manual lifting of the container is obviated by a set of wheels attached to the container upon which it can be rolled.

To remove the filled container from the housing, the gate is opened and the container is rolled out. The containers from all of the receptacles in the vicinity are brought to one pickup spot. Each container is provided with an attached hinged top which is closed after the container is removed from the housing to minimize spillage during handling. A collection vehicle stops at the designated pickup spot and all the covered, filled containers are placed into it while an equal number of empty containers are removed from it. The empty containers are then rolled to their respective housings, positioned in place, and the gates locked to ready the receptacles for operation. The vehicle carrying the filled containers proceeds to an area where each container is emptied into another vehicle which, in turn, carries the trash to a disposal site. In this manner, a fully covered, permanently fitted receptacle is provided to securely hold the deposited trash. Handling of the trash containers, even large ones, is facilitated so that no manual lifting is required. The entire operation is completed quickly, neatly and efficiently.

The present invention, therefore, provides a system wherein the trash is received in a contained manner at the initial collection point and, thus, is secure while awaiting removal. The receptacle utilized in this regard can be handled with a minimum of labor, provide adequate collection facility and can be temporarily stored until removal, if necessary. During removal, the trash is contained during rehandling and transporting, thereby eliminating scattering of trash during these operations.

Picking up of the filled containers by the transport vehicle requires minimal labor and can be performed quickly. During transport, the trash is contained and secure. Rehandling is facilitated by the container structure and requires only minimal labor. At the disposal site, the containers are easily removed from the transport vehicle and may be temporarily stored in a secure manner if the vehicle into which the trash is to be loaded is not present. Empty containers present at the disposal site may be exchanged for the full containers and no time need be wasted by the transport crew in waiting for the vehicle into which the trash is to be loaded. The filled containers are simply left at the transfer site and the trash is loaded into the vehicle when it arrives.

Further, this collection system has the advantage of versatility and flexibility as compared to present systems. Any passenger car can be utilized for transporting the container and, thus, collection can be made at any time necessary. Also, if there is an excessive concentration of garbage at a specific station which requires urgent removal, this may be promptly done by using the next outgoing train with a passenger car added solely for receptacle use.

To the accomplishment of the above, and to such other objects as may hereinafter appear, the present invention relates to a method for collecting, handling and disposing of trash, as defined in the appended claims and as described in this specification, taken together with the accompanying drawings, in which:

The primary functions of a trash receptacle, besides readily admitting deposited trash, are to hold the trash securely to prevent its being spilled or scattered after it has been deposited, and to facilitate the operation of emptying the receptacle into a collection vehicle. If the former is not performed satisfactorily, then the trash is liable to be scattered, thereby ruining the appearance of the area, even if people drop their trash into the receptacle. If the latter is not provided, trash may be scattered by trash collection personnel as it is being manually carried to or emptied into the collection vehicle.

I have found that both functions can be best accomplished by providing a two-part receptacle with each part performing one of the two functions. This is so because each of the functions calls for a structure with significantly different characteristics. Thus, for example, on the one hand, holding the trash securely required a strong, enclosed, permanently fixed structure, while on the other hand, emptying the receptacle calls for an easily accessible, readily movable and easily maneuverable structure.

Figure 1:
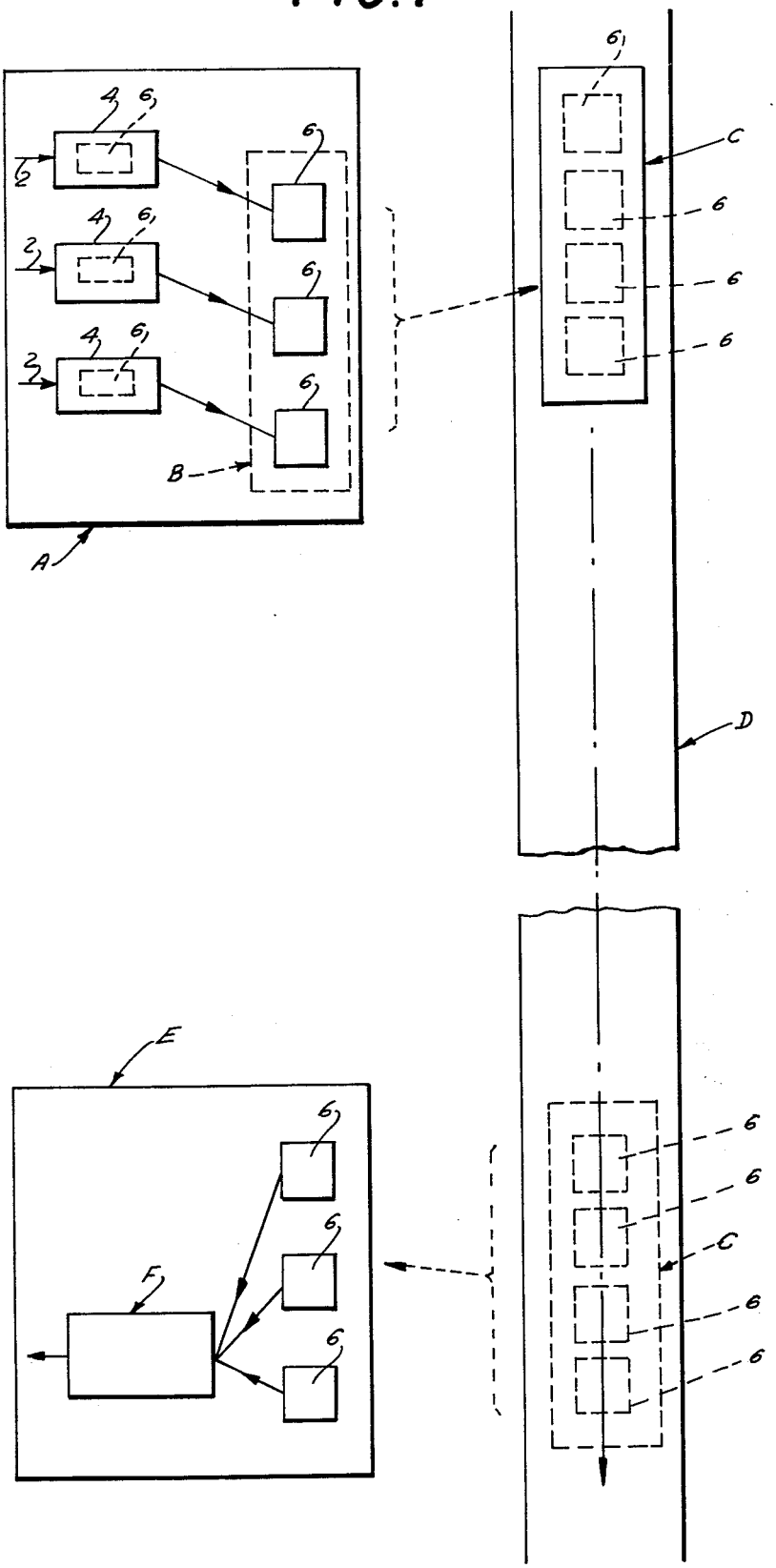
FIG. 1 is a flow diagram showing the method of the present invention.

The flow diagram of FIG. 1 depicts the method of the present invention in schematic form. As described in detail below, the receptacle 2 utilized as part of my method comprises a housing 4, permanently situated on a railroad platform or the like, generally designated A, into which a container 6 may be inserted. When containers 6 are filled, they are extracted from their respective housings 4, covered and rolled to a designated area, generally designated B, of platform A. Subsequently, a pickup train, generally designated C, will arrive alongside area B, which is preferably adjacent the track, generally designated D. Train C is filled with empty containers 6. Maintenance personnel transfer the filled containers onto train C and the empty containers from train C on platform B and thereafter into the respective housings 4.

This process is repeated at each station along the track. When filled, train C is moved to a transfer area, generally designated E. The filled containers are taken off the train and empty containers placed thereon. A collection vehicle, generally designated F, arrives at transfer area E and the full containers are emptied into the vehicle E in a manner described below.

Figure 2:
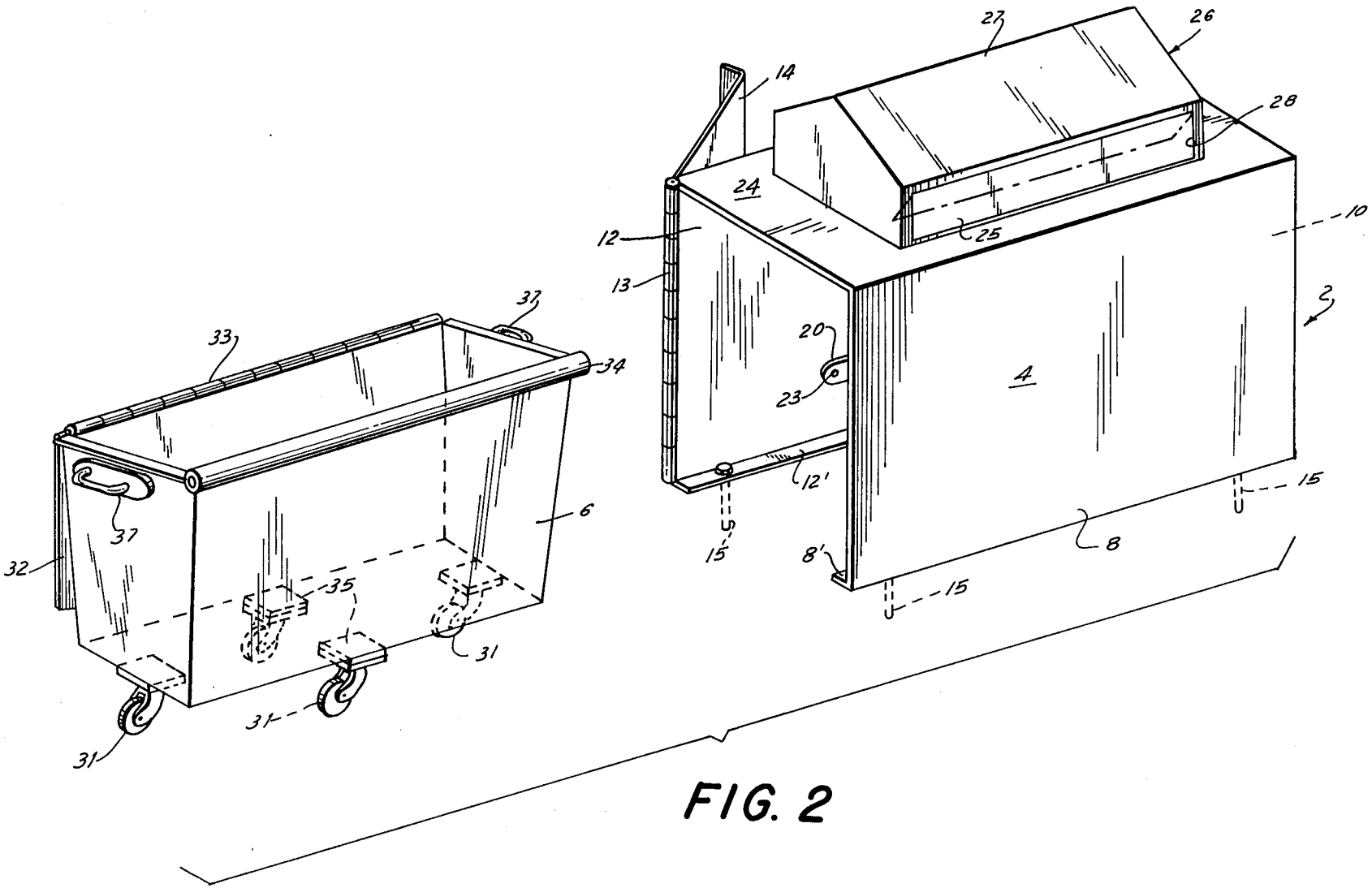
FIG. 2 is an exploded perspective view of the receptacle.

As best shown in FIG. 2, and described in detail in my copending application Ser. No. 609,703, filed Sept. 2, 1975, entitled "Rubbish Receptacle", receptacle 2 is comprised of a housing 4 and a container 6. Housing 4 has four vertical walls 8, 10, 12 and 14 and a top cover 16. The bottom edges of walls 8 and 12 are bent inward to form horizontal flanges 8' and 12'. Housing 4 is permanently fixed in position by attaching flanges 8' and 12', respectively, to the floor by any well known means, such as bolts 15. Housing wall 14 is hingeably attached to wall 12 on hinges 13 and can be swung outward to function like a gate. Gate 14 can be locked at the closed position by a latch comprised of an aperture (not shown) in gate 14 receiving a protruding bar 20 welded to the edge of and extending from wall 8. Gate 14 conceals all but the top of bar 20 for security purposes. A lock is inserted through hole 23 in the tip of bar 20. The free end of gate 14 is preferably bent so as to overlap the end portion of wall 8 when in its closed position to prevent wedging an implement between the two to force the gate open or to damage the housing.

Top 16 of housing 4 is comprised of a plate 24 having an opening 25 covered by a self-closing door assembly 26. Assembly 26 has a box-like cover 27, open at the bottom and having two apertures 28 located at opposite upstanding sides thereof. Cover 27 fits over and fully encloses opening 25 and is secured to plate 24 in any conventional manner such as by welding. Apertures 28 face the periphery of receptacle 2 to be readily accessible to the public for depositing trash therethrough. A door 29 is attached to cover 27 at the top of each aperture 28 by means of a hinge. A force applied to door 29 causes its rotation around the hinge inward of assembly 26. Thus, deflection of doors 29 inward permits the deposit of trash into receptacle 2. To keep receptacle 2 normally fully enclosed, each door 29 is provided with a biasing means (not shown) to keep it in abutment with cover 27. This biasing means can be a spring or a weighted bar, for example, which urges the door 29 outwardly. Consequently, when the trash has passed through aperture 28 and there is no longer a force pushing door 29 inward, it will swing shut automatically.

Opening 25 in plate 24 and cover 27 can be placed anywhere on top 16 of housing 4. In the preferred embodiment, these are place significantly within the periphery of top 16. This prevents trash from falling outside of container 6 since aperture 25 is positioned well within the periphery of container 6 as well, as discussed below.

The comparative dimensions of housing 4 and container 6 are such that container 6 is snugly received within housing 4. In the preferred embodiment, both have a generally rectangular shape with the height of container 6 being approximately that of the housing walls. Container 6 is rollable on four wheels 31, attached in any conventional manner to its bottom. Wheels 31 swivel to facilitate maneuvering of container 6 in small spaces. To introduce container 6 into housing 4, gate 14 is swung outwardly on its hinges 13 and container 6 is rolled inside. Once container 6 is fully inserted within housing 4, gate 14 is swung closed and a lock is inserted in hole 23 and snapped shut.

When gate 14 is locked behind container 6, deposited trash is securely maintained within receptacle 2. Since housing 4 is firmly and permanently anchored in place by bolts 15, receptacle 2 cannot be moved, jostled or overturned to scatter the deposited trash. Since the bolts 15 are inside the locked housing, vandals can't get at them without breaking the lock and opening gate 14. Similarly, container 6 cannot be removed without breaking the lock. Thus, neither housing 4 nor container 6 can be moved by anyone other than authorized personnel with a key to the lock. Moreover, the deposited trash is normally kept covered by self-closing doors 29. This arrangement prevents trash from spilling out of receptacle 2 when container 6 is nearly full. Furthermore, vandalism is inhibited because, first, the trash is not exposed and, therefore, is not a tempting target and, second, because one would have to extend his hand through aperture 28 and reach down into container 6 without being able to see what is inside. Consequently, the deposited trash is indeed securely retained within receptacle 2. In addition to all of the above, receptacle 2 is designed to receive the trash neatly so that trash collection personnel need not pick up any trash manually from the housing floor. Specifically, the snug fit between container 6 and housing 4 prevents any trash from falling between them to the floor and, thus, all deposited trash falls into container 6. Also, the door assemblies 26 are placed well within the periphery of container 6 so that the deposited trash is directed down into and well inside container 6.

Though receptacle 2 is effective in securely retaining the deposited trash, it must also facilitate handling and disposal of the trash quickly, efficiently, and neatly. To this end, container 6 is rollable on wheels 31 so that very little effort need to expended by the collection crew in moving container 6 from receptacle 2 to a central collection point, discussed in detail below. Also, it is provided with a cover 32 attached to it by hinge 33. Using the railroad platform example as discussed above, the locks on all the platform receptacles 2 are opened and container 6 are removed. As soon as container 6 is extracted from housing 4, the cover 32 which previously had rested in a down position within housing 4 is now flipped up and onto the top of container 6. This prevents the scattering or spillage of trash from container 6 during handling.

When a number of receptacles within a relatively small area must be emptied into a collection train C, it has been found to be more efficient to bring all to one central location B, adjacent truck D, at which the trash is placed into the collection train. This requires less time from the train crew which can quickly remove the trash containers and then go on to the next collection point without having to stop at each individual receptacle. To this end, all the containers 6 are rolled to one point B at which the pickup train regularly stops. Handles 37 attached at either end of container 6 and swivelable wheels 31 facilitate the manuevering of containers 6. The train crew loads the filled, covered containers 6 into one section of the train and removes from the train an equal number of empty containers 6. Once this exchange is completed, each empty container 6 is inserted into housing 4 which is locked shut and the train proceeds to its next stop. Alternatively, a station attendant can roll the containers to and from the housings, thereby requiring less time of the train crew. Of course, cover 32 of each container 6 is placed in its down position prior to insertion within housing 4.

The effect of the above-described operation is to enable the rapid exchange of containers with an efficient utilization of labor and time. Also, a smaller number of employees is required because each man can service more receptacles, since no lifting whatsoever is required. Thus, the easy job of rolling containers 6 to a central spot on the platform and rolling them into the train, can be done quickly and productively by a relatively small crew. Furtheremore, since the trash is not emptied from container 6 into a pickup train at the platform, and also because containers 6 are covered, no spillage of trash occurs during its handling by the collection crew. A further important advantage concerns the size of the receptacles which need not be restricted by the carrying capacity of a workman because containers 6 are rolled rather than carried. Consequently, receptacles 2 can be made relatively large, enabling the usage of a smaller number of receptacles. Of course, less receptacles can be emptied quicker and with less personnel to further reduce the labor, time and, therefore, the cost involved.

Figure 3:
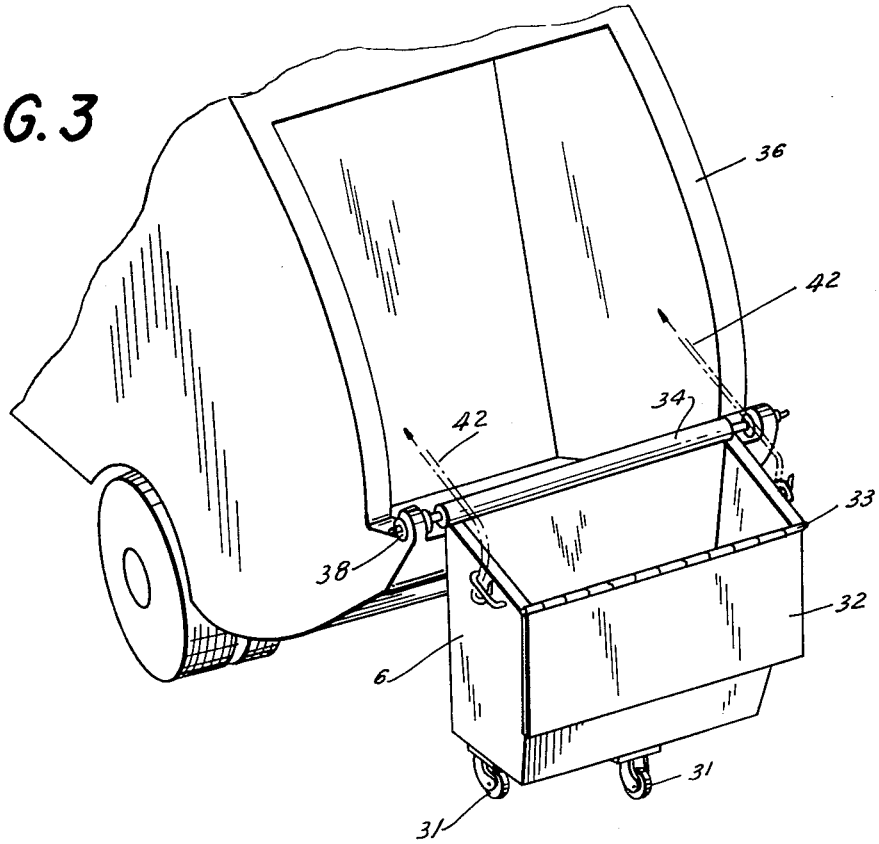
FIG. 3 is a perspective view of the container portion of the receptacle prior to being rotated into the truck for emptying the trash.
Figure 4:
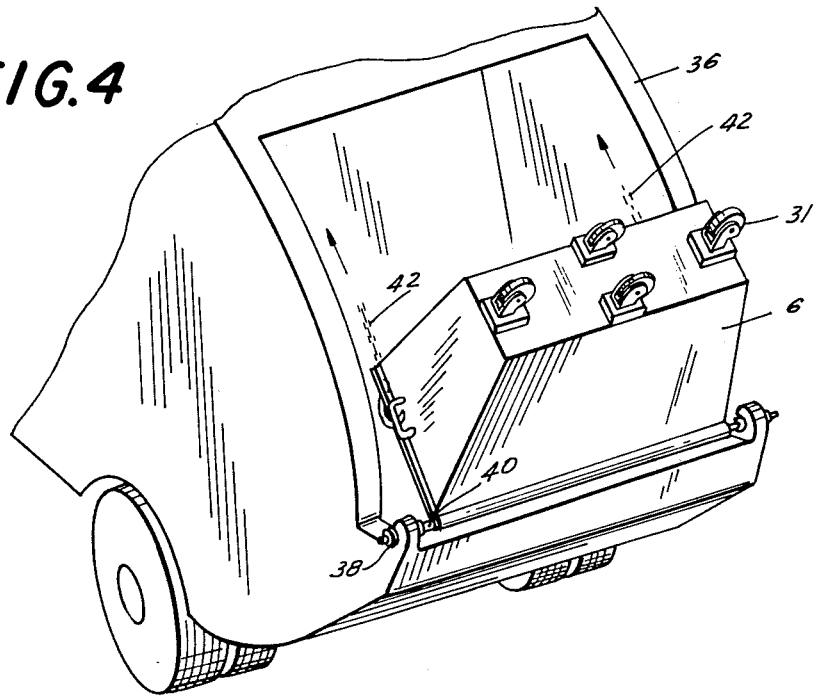
FIG. 4 is a perspective view of the container as it is emptying its contents into the truck.

The pickup train C proceeds to a terminal workyard E where the filled containers are removed and replaced with empty containers. The filled containers are emptied into another vehicle, such as a truck F, which ferries the trash to a dump site. Emptying of containers 6 into truck F can be done in a variety of ways. One possibility is to provide each container 6 with a tube 34 attached along the top edge opposite hinge 33. As best shown in FIG. 3, container 6 is moved close to the back of a truck F so that the tube 34 is aligned with recesses 38 on the truck on either side of tube 34. A rod 40 is inserted through tube 34 and recesses 38 so that container 6 is ingeably attached to truck F. A chain 42 is hooked into handles 37 on either side of container 6 and a power lifting mechanism pulls chain 42 into truck F to thereby rotate container 6 about tube 34 into the position shown in FIG. 4. When all of the trash is emptied, container 6 is brought down into its original position (FIG. 3), tube 34 is removed, and container 6 is rolled to a storage area where it awaits being placed in another collection train.

In the preferred embodiment, container 6 has wheels 31 attached at the middle of each side. This arrangement is especially advantageous when used on railroad platforms since containers 6 must traverse the gap, sometimes relatively wide, between the platform and the railroad. This arrangement of wheels makes certain that container 6 is supported by at least three wheels which are on a firm surface, whereas if the wheels were situated at the four corners of container 6, the front wheels would fall into the gap and the front of container 6 would have to be lifted over the gap. Further, it is advantageous to mount the central wheels on additional spacing members 35 or have these wheels larger than the other wheels to permit the container to be pivoted about the central wheels. Should the train be lower or higher with respect to the platform, the container 6 can then be tilted on its two centrally located wheels to lower or raise the container, the front or rear portion of the container, as needed, in order to permit transfer with a minimum of effort.

It is apparent from the foregoing that the advantages of the present invention are achieved by locking a rollable container within a normally fully enclosed and permanently fixed housing. A self-closing door at the top of the housing readily admits deposited trash and then keeps it covered to prevent scattering and spillage. Handling and disposal of the trash are accomplished by rolling the container out of the housing to a pickup point where the filled container is placed into a collection vehicle in exchange for an empty container. The trash is then hauled to a place where the filled containers are emptied into a dumping vehicle. Since the trash is not emptied into the collection vehicle at the site of the receptacle, the area is kept neat and clean. Furthermore, since little effort is required of the trash collection crew in rolling the filled containers, more work can be done better by a smaller crew providing for a more efficient operation.

While but a single embodiment of the present invention has herein been specificially disclosed, it will be apparent that many variations may be made therein, all within the scope of the instant invention as defined in the following claims.

I claim:

1. A method for collecting and transporting to a disposal site, waste materials deposited in a coverable container within a permanently affixed housing, at a location comprising the steps of:

a. uncovering an empty container and inserting same within the housing by means of an openable side thereon;
b. placing empty containers on an intermediate collection vehicle;
c. bringing said empty containers to said location on said vehicle;
d. removing a filled container from said housing through said openable side, covering same and placing the covered container on said intermediate collection vehicle;
e. replacing said filled container within said housing with an empty uncovered container carried to said housing by said vehicle;
f. transporting said filled container to a transfer site;
g. removing said filled container from said vehicle at said transfer site and emptying each into a final collection vehicle; and
h. transporting said waste materials on said final collection vehicle to a disposal site.

2. The method of claim 1 further comprising the steps of locking said openable side to said housing in a closed position after the step of placing an empty container into said housing and unlocking said openable side before removing a filled container.

3. The method of claim 1 wherein said container is rollable and tiltable, said method further comprising the step of tilting the container to facilitate transfer between said location and said intermediate collection vehicle.

* * * * *